United States Patent [19]

Ku

[11] 4,173,809

[45] Nov. 13, 1979

[54] AUTOMATIC VACUUM CLEANER

[76] Inventor: Paul H. Ku, 47-50 59th St., Woodside, N.Y. 11377

[21] Appl. No.: 920,807

[22] Filed: Jun. 30, 1978

[51] Int. Cl.[2] ..... A47L 9/28

[52] U.S. Cl. ..... 15/319; 15/339; 15/340

[58] Field of Search ..... 15/319, 339, 340, 327 R

[56] References Cited

U.S. PATENT DOCUMENTS

| | | | |
|---|---|---|---|
| 1,935,158 | 11/1933 | Lumley | 15/319 |
| 3,010,129 | 11/1961 | Moore | 15/319 X |
| 3,267,510 | 8/1966 | Cote | 15/344 |
| 3,713,505 | 1/1973 | Muller | 15/319 X |

FOREIGN PATENT DOCUMENTS

| | | | |
|---|---|---|---|
| 722755 | 1/1932 | France | 15/320 |

*Primary Examiner*—Christopher K. Moore

[57] ABSTRACT

In a preferred embodiment, a battery embodying and driven vacuum cleaner having a battery-recharging unit, having a pivoted and pivotably-driven driven wheel indirectly driven by an electric motor powered by the battery, and having other free-wheeling support wheels supporting the vacuum cleaner structure, and a vacuum cleaner vacuum motor driven by the electric motor, and a timer unit for setting the time of beginning and ending period of vacuuming, adapted to move randomly across a carpet and to change direction of movement whenever an obstacle is encountered.

2 Claims, 3 Drawing Figures

AUTOMATIC VACUUM CLEANER

This invention relates to an automatic vacuum cleaner.

BACKGROUND TO THE INVENTION

Prior to the present invention, while there have been portable vacuum cleaner such as auto vacuum cleaners with a cord connected thereto, such unit is a hand-held unit devoid of rollers or the like, and certainly is not what might be suggestive of a home dwelling automatic roller-vacuum cleaner.

On the other hand, all vacuums prior to the present invention for roller-vacuuming of the home carpet such as is to found in the typical living room of a dwelling, are cord-connected electrically-driven by house AC 110 current, having a conventional off-on switch.

SUMMARY OF THE INVENTION

The present invention has as a major object the obtaining of a vacuum cleaner which randomly travels about a carpet and changes direction when an obstacle is encountered, while vacuuming the carpet.

Another object is to obtain an automatic vacuum cleaner cordless for freedom of movement in random uncontrolled directions, for the vacuuming of carpet, driven by rechargeable battery.

Another object is to obtain a carpet vacuum cleaner having a presetting timer mechanism for automatic vacuuming devoid of guidance by a person.

Another object is to obtain an automatic carpet vacuum cleaner having a battery recharge mechanism.

Other objects become apparent from the preceding and following disclosure.

One or more objects of the invention are obtained by the embodiments disclosed herein in preceding and following disclosure.

Broadly the invention may be described as an automatic vacuum cleaner having a vacuum cleaner mechanism and structure for supporting the same, for vacuum cleaning carpet by movement thereacross, and having roller and driven wheel mechanism, and a driving electric motor, and a battery and circuitry thereof connected to drive the vacuum mechanism and to drive the driven wheel by the driving electric motor. The roller and driven wheel mechanism are arranged by conventionally known prior art in a manner such that the vacuum cleaner support structure is driven to mover randomly in alternate directions intermittently changing direction whenever an obstacle is encountered, in the same manner as conventionally-available toys; the present mechanism in the illustrated embodiment has forward supporting roller, and a rearward central wheel driven by an electric motor through intermediate gearing including a revolvable pivoted mount mounting the driven wheel, with the pivot conventionally loosely mounted such that whenever a obstacle is encountered, the loosely-mounted pivoted mount is cause to shift sufficiently to engage driving gear mechanism to cause the pivoted mount to revolve sufficiently for the driven wheel to cause the vacuum cleaner to move-off in a new direction.

In one preferred embodiment, the battery is a rechargeable battery and there is included a battery recharger, which may be separately connectable—i.e. not mounted on the support structure, or alternatively may be built into the vacuum casing on the support structure. An advantage to having it separate, is the factor of less mass to be pushed-around by the small motor utilized as necessitated by a battery drive, in order to maintain a minimally-sized battery, for the same reason as well as for required compactness of the vacuum cleaner as a whole. There also is included in this embodiment, a switching circuitry for the switching to and from connecting the battery and circuitry thereof to the rectifier and transformer, and alternately for connecting the battery and its circuitry to the electrically-driven motor—which would be the equivalent of an off-on switch, except additionally with a position for the recharge-circuitry connections.

In a still other preferred embodiment, there is included additional switching mechanism for selectively cutting-out the battery-circuitry, and simultaneously connecting the output from the rectifier and transformer unit directly to the electric motor for direct current directly to the electrically-driven motor, it being noted that this is a motor of a voltage driven normall by the battery and thus still requiring the intermediate rectifier and transformer unit to be present in such embodiment and connection.

In a still other preferred embodiment, there is a timer unit of any desired type, such as one which is merely of a spring type which winds-down when turned (would), winding down over a predetermined period during which the battery circuitry is connected to the electrically driven motor, i.e. the vacuum is vacuuming and the vacuum support structure is wandering randomly around the room and carpet being vacuumed until the switch winds-down. In a more sophisticated version, a timer is set to turn-on at a predetermined period—and if no turn-off setting, the vacuum will run until the battery is discharged. If the embodiment includes a timer which also is set to turn-off at a prescribed time or after a predetermined period of running, the vacuum will clean and wander around the carpet's surface during the on-period, and then turn-off when the timer deactivates.

It is understood that the invention may be devoid of the preferred embodiments, or may contain any one or more thereof.

The invention may be understood more fully by making reference to the following drawings.

THE FIGURES

DETAILED DESCRIPTION OF THE INVENTION

Figure 1:
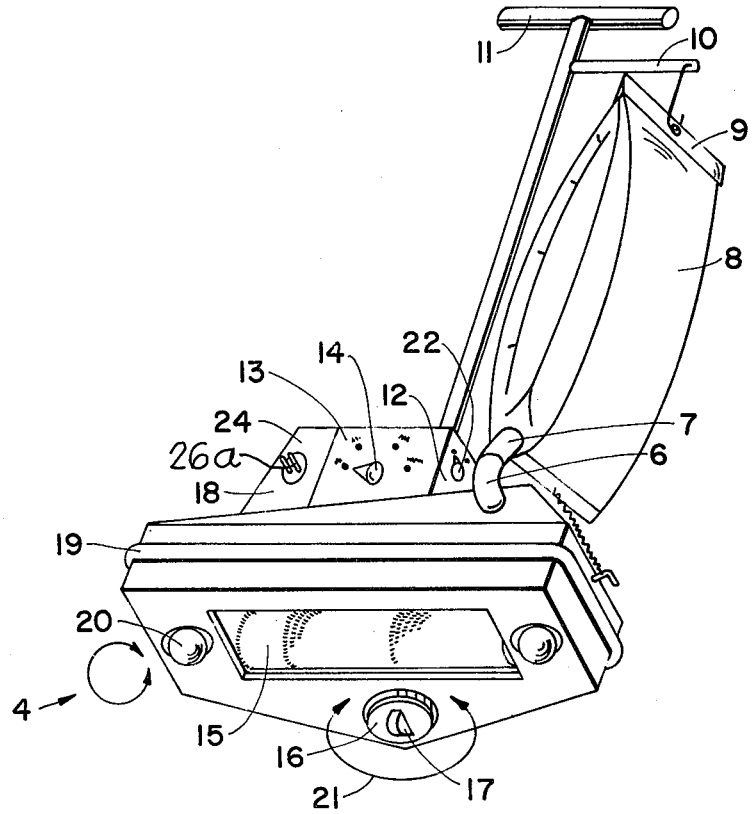
FIG. 1 illustrates a bottom and side perspective view of a preferred embodiment of the invention of the automatic vacuum cleaner.
Figure 2:
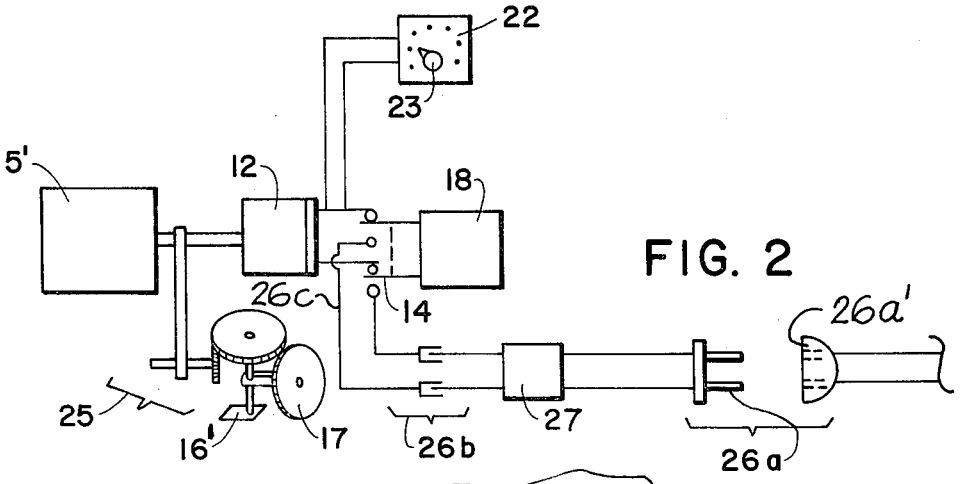
FIG. 2 illustrates diagrammatically and symbolically an arrangement and interconnection of mechanical parts and circuitry thereof, for the embodiment of FIG. 1.
Figure 3:
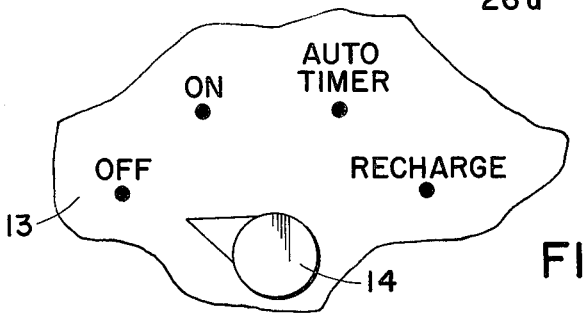
FIG. 3 illustrates a front view in part-view, of the switch dial and selector switch in an enlarge view, as might be typical, and is present on the FIG. 1 embodiment.

FIGS. 1 through 3 disclose a common embodiment embodying preferred features. The embodiment of the invention is vacuum cleaner unit 4 composed of its integral parts and accessories. The vacuum cleaner support structure 5 is mounted on multi-directional ball-wheels 20 at each of the forward corners, and on a rotatably-pivotal mount 16 and driven wheel 17 thereof, the rotatably-pivotal mount 16 also being intermittently driven rotatably whenever the unit becomes jarred (shaken) by bumping into some obstacle with the typically elastic bumper 19; such support mounted on such pivot ball wheels and such driven rotatably-pivotal mount and driven wheel thereof are conventionally known and available commercially prior to this invention, heretofore embodied in change-of-direction motorized toys.

Spaced between the ball-wheels is a vacuum cleaner inlet port for vacuuming of a carpet, and preferably having mounted therein the conventionally-driven beater-brush 15 as a part of the driven vacuuming mechanism driven by the rod (shaft) extending from the electrically-powered motor 12 thereby drivably connected to the vacuum cleaner mechanism 5'. The symbolically-represented switch (control switch) 24 which is shown diagrammatically in FIG. 2, is capable of switching between off, on, manual-on or battery-on being separate choices, and automatic timer, and recharge positions, as shown in the in-part view in enlargement of FIG. 3; note that manual-on position connects the rectifier-transformer leads 26 directly to the electrically-driven motor 12, and that the battery-on connects the battery 18 directly to the electrically-driven motor 12; when the Figure selector switch 14 is turned to recharge position, the rectifier-transformer leads 26 are thereby connected directly to the battery leads into a proper recharge-connection circuitry in accord with conventional technology commercially-available. Typical positions, but such positions being optional, are illustrated in FIG. 1, for the switch dial 13 (shown in FIG. 3 also), the recharging unit (switching-circuit) 24, male-female electrical plug-receptacle **26*a* and 26*a'*, drive wheel 17, vacuum outlet male-force-fit tube 6 and its mating female-force-fit tube 7 which is the inlet to the collection bag 8 having slip-on closure and support element 9 suspended by vacuum bag support arm 10, and manual-guide handle 11, and timer switch 22, and battery 18, other conventional parts not being separately identified. The timer switch box 22 has setter switch 23** for setting the activation period, and is in the electrical circuit such that electrical circuitry is made or broken thereby to the electrically-driven motor. The timer switch would normally be manually set solely when it is desired to run on automatic, i.e. on battery, and for a predetermined selected period of time. The exact nature of the timer switch is intentionally not specified, for reason that it is intended that optionally any of several types might be alternately utilized here; for example, it may be of the type on an alarm radio which comes on (makes-contact circuit) at the set-time and/or goes-off at the set-time, or the like. It is also within ordinary skill to adjust the location in the electrical circuitry in some conventional manner in order to obtain some other version of timer-control.

The FIG. 2 illustration shows the connector plug-unit **26*b* which is intended to illustrate that the rectifier and transformer unit 27 may be detached, apart from the mobile vacuum cleaner and merely attached during a desired charging (recharging) operation when connected with an appropriate female receptacle by male receptacle 26*a*, the female receptacle being represented as 26*a'* (which could be a wall receptacle). On the other hand, such connector plug unit 26*b* is optional, whereby the rectifier and transformer unit may be mounted on the mobile unit at all times either with or without the connector plug unit 26*b*, i.e. there may be unbroken circuitry. However, an advantage to having the rectifier and transformer unit separate is that there is no need for the small typically twelve (12) volt motor of the vacuum cleaner—driven by typically a twelve volt battery, to have the additional mass of the rectifier and transformer unit to be pushed-around. The rectifier is necessary to convert the typical 110 volt house-electrical current to direct current in combination with a transformer necessary to step-down the voltage to twelve volts necessary for either battery recharge or for direct-drive of the electrically-driven motor (12 v) 12, typically recharging at 4 amp for (over a period of) one hour or less. An advantageous use of the timer is to set the vacuum cleaner to turn-on at the end of a recharging period—and as the vacuum is turned-on, it would move-away and pull-loose from the recharge cord; in such embodiment, the switch circuitry must a physical structural connection with the switch unit selector switch 14 such that when the timer turns-on the machine, the circuitry will also simultaneously switch from the recharge position to the battery-position; such modification is purely mechanical and an ordinary artisan's modification within skill of conventional known art, utilizing whatever additional circuitry may be desired to acheive such effect; alternately, in even the illustrated circuitry, merely an additional position is required which connects the battery simultaneously to the inlet to the timer switch and to the inlet lead of inlet leads 26*c*, whereby when the timer switch 22 closes circuit, the vacuum motor and drive unit merely pull-away from the recharging unit or receptacle 26*b***, for example. The long-lasting battery of the present invention is conventionally commercially-available, and is of the nickel-cadmium battery and cells type such as Nos. 70,942 or 70,969 or 72,108 or 61,038, or 41,109, or 41,735, or 41,736, of the nature set-forth in the circular 711188-1, Rev. 3/77 of the Information And Instructions of Edmund Scientific Co. of Barrington, N.J. The vacuum cleaner motor driven by this battery for the present invention is typically a 120 watt motor which operates on a 12 Volt/DC, using typically about 10 amps (i.e. per hr.) and thereby lasting typically 3 hours and twenty minutes of vacuuming. At such long period of use before requiring a recharging, even a very large rug or carpet may be vacuumed by a randomly wandering vacuum cleaner of the present invention.

The FIG. 2 diagrammatically represents the mobile drive force being transmitted through conventionally known gearing 25. The pivot mount 16 is conventionally loosely mounted on a support 16' for intermittent engagement by a driver disc(toothed) as a part of the symbolic gearing 25 indirectly driven by the electrically driven motor 12.

It is within the scope of the invention to make variations and modifications and substitutions within ordinary skill of the artisan in this field.

I claim:

1. An automatic vacuum cleaner comprising in combination: a vacuum cleaner means for vacuuming a carpet, the vacuum cleaner means including support structure; roller means for rollably-supporting the support structure and mounted on the support structure; driven-swivel wheel means for supporting and propelling in diverse directions and mounted on said support structure; said roller means and said driven-swivel wheel means and the support structure in combination being adapted for moving the support structure randomly in alternate directions and intermittently changing direction whenever an obstacle is encountered;

electrically-driven motor mounted on said support structure connected to drive said vacuum cleaner means and connected to drive said driven-swivel wheel means; battery means connected to supply power to said electrically-driven motor, said battery means including a rechargeable battery and motor-drive circuitry connected in circuit with the rechargeable battery such that power is providable to said electrically-driven motor, and said battery means additionally including a battery recharging circuitry means for recharging the rechargeable battery when connected to a source of outside electrical power, the battery recharging circuitry means including a rectifier and transformer interconnected with said rechargeable battery such that low voltage rectified direct electrical current is providable to the rechargeable battery in recharging circuitry; switching circuitry for switching to and from connecting said rechargeable battery means to said rectifier and transformer, and for connecting said battery means to said electrically-driven motor; and a timer means for setting activation time, period of running subsequent to an activation, and for deactivation of said switching circuitry for that portion of the switching circuitry for connecting and disconnecting the rechargeable battery to and from said electrically-driven motor.

2. An automatic vacuum cleaner of claim 1 in which said switching circuitry includes a switch adated to alternately switch between connections to (a) said rechargeable battery and (b) said rectifier and said transformer, the switch being connected directly to said electrically-driven motor driven by electrical power optionally from the rechargeable battery or from a source of outside electrical power derived through the rectifier and the transformer.

* * * * *